US008020622B2

(12) United States Patent
Richard

(10) Patent No.: US 8,020,622 B2
(45) Date of Patent: Sep. 20, 2011

(54) ANNEALING OF MATERIALS DOWNHOLE

(75) Inventor: Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 387 days.

(21) Appl. No.: 12/017,237

(22) Filed: Jan. 21, 2008

(65) Prior Publication Data

US 2009/0183868 A1 Jul. 23, 2009

(51) Int. Cl.
*E21B 36/00* (2006.01)
*E21B 29/02* (2006.01)

(52) U.S. Cl. ..... 166/302; 166/57; 166/63; 166/300; 166/384

(58) Field of Classification Search ..... 166/300, 166/302, 303, 277, 272.3, 207, 384; 72/283, 72/370.06, 370.07, 370.08, 342.7, 342.8
See application file for complete search history.

(56) References Cited

U.S. PATENT DOCUMENTS

| | | | | | |
|---|---|---|---|---|---|
| 3,322,195 | A | * | 5/1967 | Brown et al. | 166/300 |
| 3,376,932 | A | * | 4/1968 | Hunt | 166/59 |
| 3,497,000 | A | * | 2/1970 | Hujsak et al. | 166/59 |
| 3,817,332 | A | * | 6/1974 | Berry et al. | 166/302 |
| 3,980,137 | A | | 9/1976 | Gray | |
| 4,149,597 | A | | 4/1979 | Redford | |
| 4,237,973 | A | | 12/1980 | Todd | |
| 4,380,267 | A | | 4/1983 | Fox | |
| 4,442,898 | A | | 4/1984 | Wyatt | |
| 4,475,596 | A | | 10/1984 | Papst | |
| 4,498,531 | A | | 2/1985 | Vrolyk | |
| 4,558,743 | A | | 12/1985 | Ryan et al. | |
| 4,574,886 | A | | 3/1986 | Hopkins et al. | |
| 4,641,710 | A | | 2/1987 | Klinger | |
| 4,699,213 | A | | 10/1987 | Fleming | |
| 4,706,751 | A | | 11/1987 | Gondouin | |
| 4,783,585 | A | | 11/1988 | Meshekow | |
| 4,834,174 | A | | 5/1989 | Vandevier | |
| 4,930,454 | A | | 6/1990 | Latty et al. | |
| 5,052,482 | A | | 10/1991 | Gondouin | |
| 5,348,095 | A | * | 9/1994 | Worrall et al. | 166/380 |
| 5,449,038 | A | | 9/1995 | Horton et al. | |
| 5,911,684 | A | | 6/1999 | Shnell | |
| 7,640,987 | B2 | * | 1/2010 | Kalman et al. | 166/303 |
| 2005/0023002 | A1 | * | 2/2005 | Zamora et al. | 166/382 |
| 2008/0083537 | A1 | * | 4/2008 | Klassen et al. | 166/302 |

OTHER PUBLICATIONS

Shelley, Tom. "Steaming Ahead." Eureka Magazine Online, May 11, 2007. Retrieved online Jan. 3, 2008 from, "http://www.eurekamagazine.co.uk/article/11693/Steaming-ahead.aspx?u=7889".

Morgan, Nina. "Instant Steam Feature Article." Oxford Catalysts Group PLC Online, Jul. 30, 2007. Retrieved online Jan. 3, 2008 from, "http://www.oxfordcatalysts.com/press/pr20070730.html".

* cited by examiner

*Primary Examiner* — David Bagnell
*Assistant Examiner* — Robert E Fuller
(74) *Attorney, Agent, or Firm* — Cantor Colburn LLP

(57) ABSTRACT

A downhole annealing system includes a component to be annealed; a steam generating catalyst in proximity to the component; and a reactant fuel selectively communicative with the catalyst to produce an exothermic reaction and method.

13 Claims, 4 Drawing Sheets

ANNEALING OF MATERIALS DOWNHOLE

BACKGROUND

In the hydrocarbon recovery arts, there is need for many different types of materials in the wellbore. This is due to particular applications, particular requirements of the materials, etc. In some cases, materials are introduced into the wellbore in a condition that facilitates their introduction but they suffer in the downhole environment because of that initial condition. While methods have been used to, for example, cure resinous materials in the downhole environment to change the operating properties thereof, such methods have been limited to various plastic materials or shape memory alloys. While these materials have great utility in some settings, they of course do not satisfy all needs.

SUMMARY

An expansion cone includes a cone; a steam generating catalyst disposed at the cone; and a pathway for fuel reactant in fluid communication with the catalyst.

A downhole annealing device includes a runable downhole tool; a steam generating catalyst at the downhole Tunable tool; and a fuel reactant pathway at the tool in fluid communication with the catalyst.

A method for annealing components in a downhole environment includes running a catalyst into proximity with the component to be annealed; and supplying a reactant fuel to the catalyst to chemically produce steam at the cite of annealing.

A method for annealing components downhole includes causing a steam generating catalyst to contact a reactant fuel mixture; reacting the reactant fuel mixture with the catalyst; generating a change in temperature by exothermic reaction; generating steam as a product of the exothermic reaction; and applying the steam to the component to anneal the component.

A downhole annealing system includes a component to be annealed; a steam generating catalyst in proximity to the component; and a reactant fuel selectively communicative with the catalyst to produce an exothermic reaction.

BRIEF DESCRIPTION OF THE DRAWINGS

Referring now to the drawings wherein like elements are numbered alike in the several Figures.

DETAILED DESCRIPTION

Metal downhole components such as screens and other tubulars are often expanded from a run-in set of dimensions to a final set of dimensions that is/are larger than the set of run-in dimensions. This process tends to work harden the components and in some cases causes a tool manufacturer to select different starting materials than they otherwise might have selected to ensure reliability and longevity of the component.

In addition, manufacturers-are sometimes required to incur expenses related to research and development in order to address the work hardening issue. Annealing the components during or after expansion (or other deformation) would significantly help to improve the components but there heretofore have been no means of annealing materials in the downhole environment.

Figure 1:
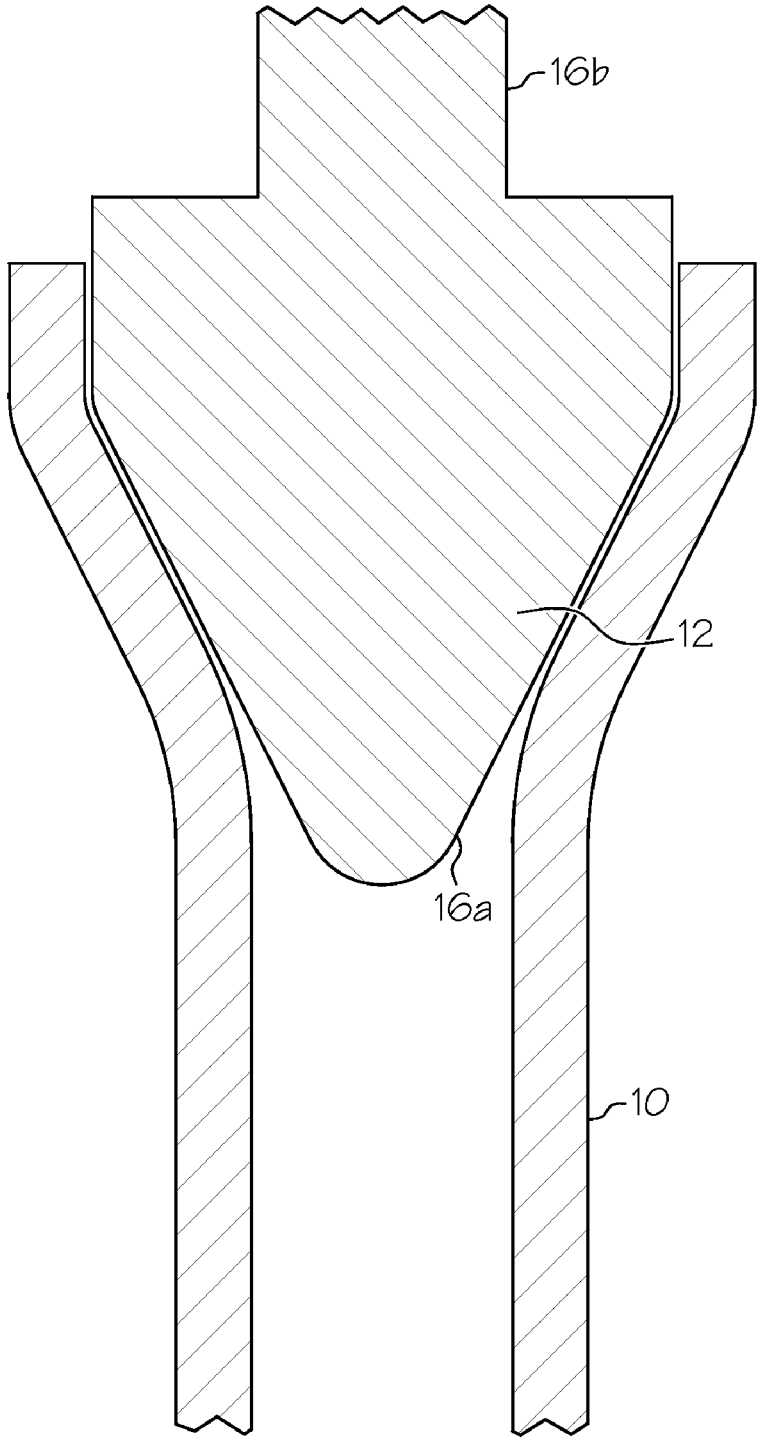
FIG. 1 is a schematic view of an expansion cone during expansion of another tubular.

Referring to FIG. 1, a schematic illustration of a component 10 being expanded by an expansion cone 12 is provided for environment. It is intended that the drawing figure be recognized as representative of many different types of expansion operations and expansion components. As noted above, most of the tubular components expanded will undergo work hardening that is not necessarily desirable. In such cases, annealing the component will improve the properties thereof for use in the downhole environment. In connection with the disclosure hereof, the annealing of these components in the downhole environment is now possible.

Figure 2:
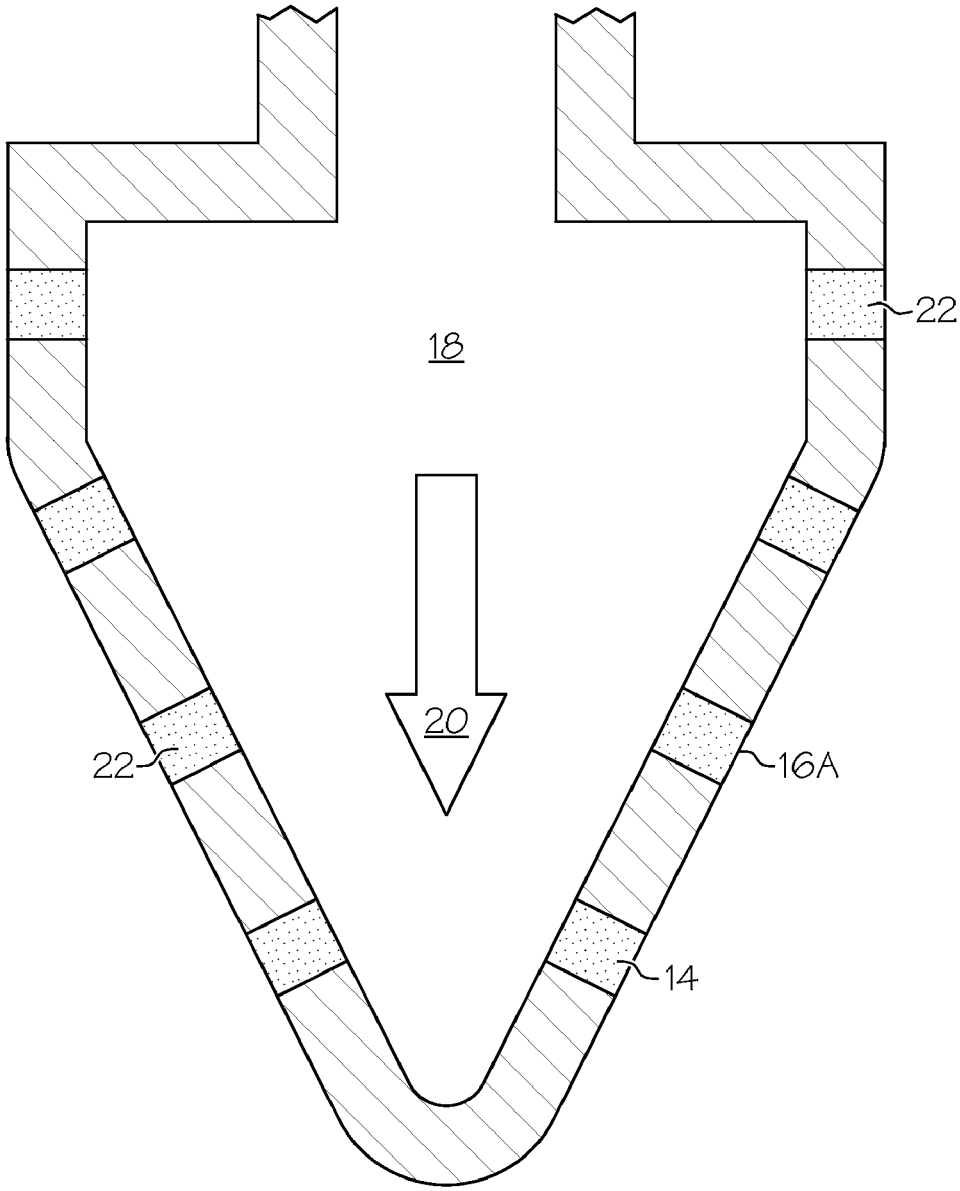
FIG. 2 is a schematic sectional view of a cone illustrating features thereof.
Figure 3:
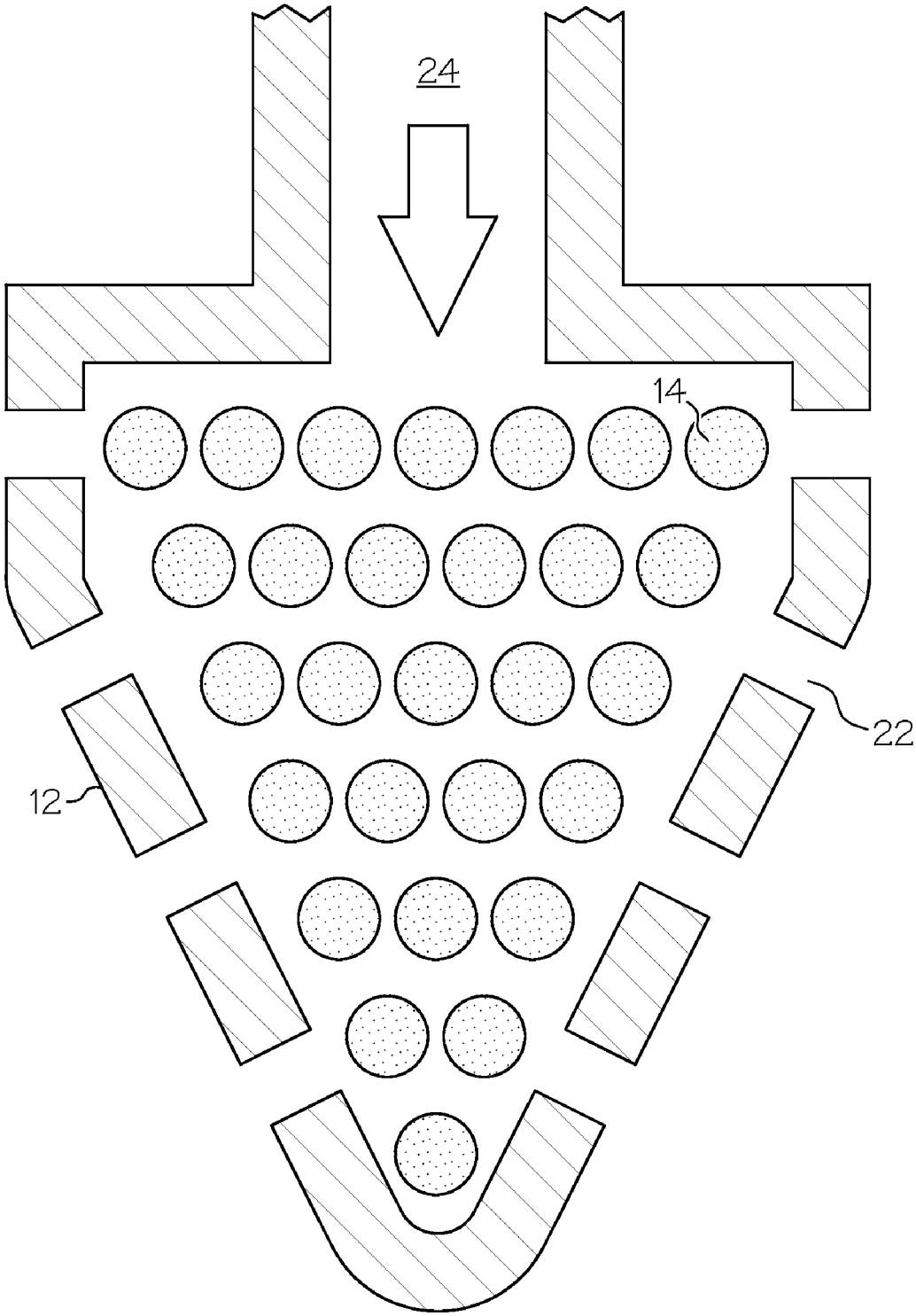
FIG. 3 is a schematic sectional view of a cone illustrating alternate features thereof.

A powdered precious metal-based catalyst 14 (available from Oxford Catalysts Group PLC trading under Oxford Catalysts Limited, 115e Milton Park, Oxford, OX14 4RZ, UK) is applied at the cone 12 in a number of different embodiments depicted in FIGS. 2 and 3. A reactant fuel (aqueous methanol and hydrogen peroxide) is then supplied to the catalyst whereby an exothermic reaction takes place. The reaction produces water, carbon dioxide and heat thereby generating steam at a selected temperature up to about 1500° F. and at atmospheric pressure. The pressure with which the steam is applied to an end target can be adjusted by increasing or decreasing the pressure of the reactant fuel mixture supplied to the catalyst. The component 10 may be annealed simultaneously with the expansion, immediately after expansion or both when the reactant fuel is exposed to the catalyst. The annealing is effected by the heat of the steam generated by the exothermic reaction of the reactants when in contact with the catalyst.

In one embodiment, the cone 12 is hollow and includes an outside surface 16*a*, 16*b* and an inside surface 18. The inside surface 18 defines a volume that is fluidically connected to a supply of reactant fuel that may be local or remote. One advantage of having the fuel in a local store is that less of it will be necessary to affect the desired heating as it will not need to extend a long distance through conduit to a supply location. Advantages of having a remote supply location on the other hand is the likelihood that more space is available for storage and injection pressure is applied directly to the fuel. Returning to the structure of the cone, included is a plurality of through openings 22 that extend from the inside surface 18 to the outside surface 16*a*, 16*b*. In this embodiment, the catalyst 14 (see FIG. 2) is placed within each of the openings 22 in a configuration that allows fluid to flow therethrough. Placing the catalyst in these locations, where the reactant fuel is supplied though the inside of the cone 12 as noted, necessarily requires that the fuel reactant must pass through the catalyst 22 and be catalyzed resulting in an efficient system for generating steam and therefore heat. The steam exiting the openings 22 at surface 16*a*, 16*b* or both directly impinges upon the target component thereby heating and annealing the same. It is to be appreciated that the surface 16*a* will be in direct loaded contact with the component while surface 16*b* will be in close proximity with but not loaded contact with the component 10. Depending upon the application, it may be desirable to heat the component in the zone where it is stretching alone (at surface 16*a*) in the zone immediately post where stretching has taken place (at surface 16*b*) or both. These variations can be achieved by placing the openings 22 at surface 16*a*, 16*b* or both.

In another embodiment, referring to FIG. 3, the catalyst is disposed within the cone 12. In this embodiment, the reactant fuel is not passed through openings 22 as in the above-discussed embodiment but rather is passed into and through (via a conduit 24 embedded in the catalyst) or around the catalyst 14 while still inside the cone 12. The resulting steam itself then utilizes the openings 22 to escape from the cone 12 and thereby heat and anneal the component 10. It is to be appreciated that in this embodiment, like the one described immediately hereinabove, the openings 22 can be placed at surface 16*a*, 16*b* or both as desired.

Notwithstanding the foregoing discussion of cones, it is to be appreciated that the annealing process could be carried out after the expansion is completed utilizing the same or another tool having been fitted with the catalyst. Moreover, Heat treatment made possible through the use of the configurations disclosed herein is not necessarily limited to expanded components but could be utilized for any desired heat treating process in the downhole environment.

Figure 4:
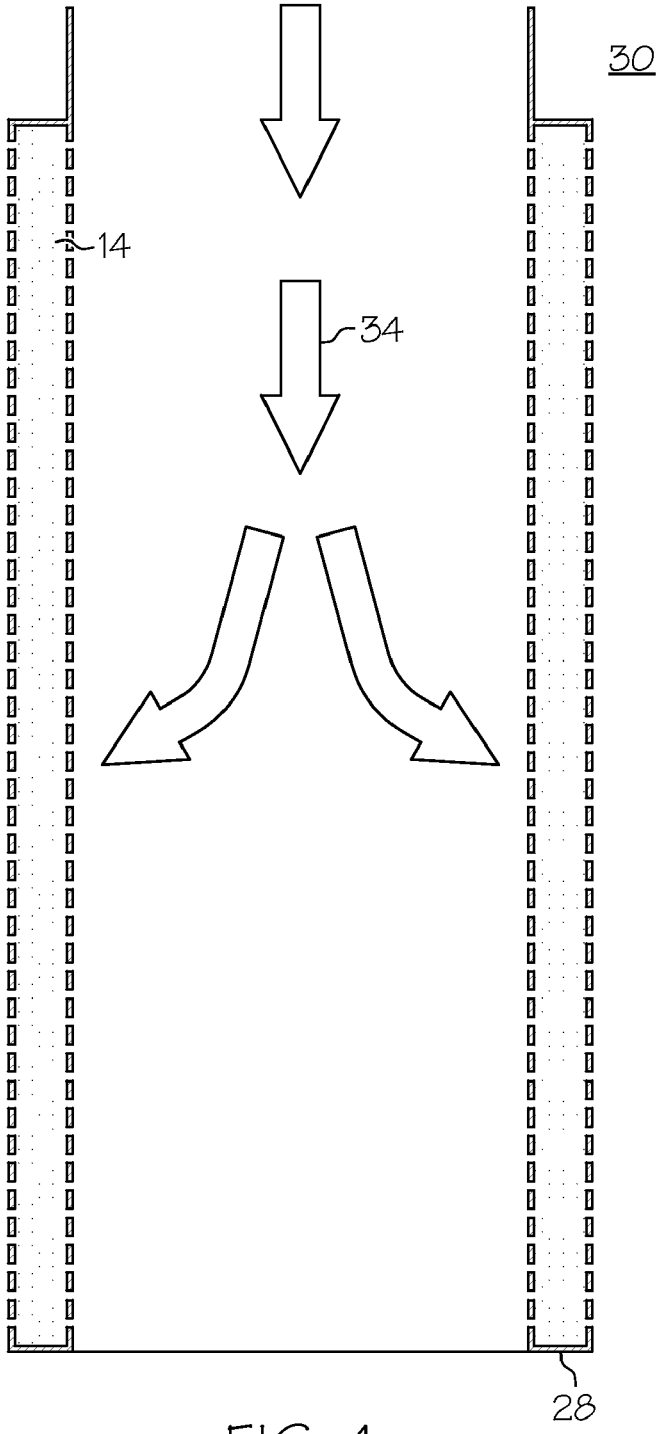
FIG. 4 is an alternate embodiment wherein a catalyst is disposed at the component to be annealed rather than at another tool coming into proximity with the component to be annealed.

In another embodiment, referring to FIG. 4, the catalyst 14 is disposed at the component to be annealed, by utilizing a double wall screen 28 mounted to a string 30, for example. Reactant fuel can be supplied through the inside dimension of the string 30 (see arrow 34) and be forced radially outwardly through the catalyst 14 generating steam. While illustrated with only a line in FIG. 4, it is considered axiomatic that the fluid must be at least partially dead headed downstream of the screen so that a fluid pressure can be developed in the reactant fuel to move the same through the catalyst. It is of course contemplated that the steam could be directed radially inwardly by mounting the screen inside the string and plumbing fuel to a radially outward surface thereof while leaving the radially inward surface open. Steam would then be supplied radially inwardly which might be of use for situations involving an overshot tool.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. An expansion cone configured to expand a downhole tubular comprising:

a cone configured to plastically expand the downhole tubular;

a steam generating catalyst disposed at the cone; and a pathway for fuel reactant in fluid communication with the catalyst.

2. The expansion cone as claimed in claim 1 wherein the cone includes a plurality of openings therein.

3. The expansion cone as claimed in claim 2 wherein the catalyst is disposed in each of the openings.

4. The expansion cone as claimed in claim 1 wherein the catalyst is disposed within the cone.

5. The expansion cone as claimed in claim 1 wherein the pathway for reactant fuel is within a string to which the cone is connected.

6. The expansion cone as claimed in claim 1 wherein the pathway for reactant fuel is a conduit embedded in the catalyst.

7. A method for annealing components previously or contemporaneously work hardened in a downhole environment comprising:

running a catalyst into proximity with the previously or contemporaneously work hardened component to be annealed; and supplying a reactant fuel to the catalyst to chemically produce steam at the site of annealing.

8. The method as claimed in claim 7 wherein the supplying is by pumping the reactant fuel into the downhole environment.

9. A method for annealing components downhole comprising:

causing a steam generating catalyst to contact a reactant fuel mixture;

reacting the reactant fuel mixture with the catalyst;

generating a change in temperature by exothermic reaction;

generating steam as a product of the exothermic reaction; and applying the steam to the component to anneal the component.

10. A downhole annealing system comprising:

a contemporaneously or previously work hardened component to be annealed;

a steam generating catalyst in proximity to the component; and a reactant fuel selectively communicative with the catalyst to produce an exothermic reaction.

11. The system as claimed in claim 10 wherein the catalyst is on the component.

12. The system as claimed in claim 10 wherein the catalyst is on a separate tool from the component.

13. The system as claimed in claim 10 wherein the catalyst is in the component.

* * * * *